US007377323B2

(12) United States Patent
Walker et al.

(10) Patent No.: US 7,377,323 B2
(45) Date of Patent: May 27, 2008

(54) BLOWOUT PREVENTER STACK LANDING ASSIST TOOL

(75) Inventors: Stephen J. Walker, Houston, TX (US); Lan T. Hiscox, Magnolia, TX (US)

(73) Assignee: Cameron International Corporation, Houston, TX (US)

( * ) Notice: Subject to any disclaimer, the term of this patent is extended or adjusted under 35 U.S.C. 154(b) by 262 days.

(21) Appl. No.: 11/038,721

(22) Filed: Jan. 20, 2005

(65) Prior Publication Data

US 2006/0157236 A1 Jul. 20, 2006

(51) Int. Cl.
*E21B 33/038* (2006.01)

(52) U.S. Cl. ..... 166/348; 166/341; 166/345

(58) Field of Classification Search ..... 166/341–343, 166/345, 348

See application file for complete search history.

(56) References Cited

U.S. PATENT DOCUMENTS 3,721,292 A * 3/1973 Ahlstone ..... 166/359
4,667,986 A 5/1987 Johnson
6,260,624 B1 7/2001 Pallini
6,540,024 B2 * 4/2003 Pallini et al. ..... 166/348

FOREIGN PATENT DOCUMENTS

EP 0338154 A1 10/1989
EP 0448871 B1 7/1994

OTHER PUBLICATIONS

UK Patent Office Combined Search and Examination Report for Appln. No. GB0601070.6 dated: Apr. 12, 2006 (pp. 4).

* cited by examiner

*Primary Examiner*—Giovanna C Wright
(74) *Attorney, Agent, or Firm*—Conley Rose, P.C.

(57) ABSTRACT

A blowout preventer stack landing assist tool and landing tool adapter joint for use with a standard telescoping joint used in oil and gas drilling operations that allows lifting and moving of the riser string and blowout preventer stack without requiring disconnection of the telescoping joint, tensioning lines and associated piping from the riser string connection.

22 Claims, 9 Drawing Sheets

BLOWOUT PREVENTER STACK LANDING ASSIST TOOL

BACKGROUND OF THE INVENTION

1. Field of the Invention

This invention relates to a blowout preventer stack landing assist tool for use with a telescoping joint having a riser string and blowout preventer stack secured to the lower end of said telescoping joint. Such assemblies commonly are used in offshore oil and gas drilling operations performed from a semisubmersible drilling rig or a drilling platform.

Offshore oil and gas drilling operations utilize a wellhead housing supported on the ocean floor with a blowout preventer stack secured at its upper end. A blowout preventer stack is an assemblage of blowout preventers and valves used to control well bore pressure within the wellhead housing. The upper end of the blowout preventer stack has an end connection or riser adapter that allows the blowout preventer stack to be connected to a series of pipes, known as riser or riser pipe, connected in end to end relationship to form a riser string. This riser string extends upwardly to the drilling rig or drilling platform positioned over the wellhead housing.

In order to prevent the riser string from collapsing under its own weight, it is necessary for the riser string to be supported at the ocean surface by the drilling rig. This support takes the form of a hydraulic tensioning system and telescoping joint that connect to the upper end of the riser string and maintains tension on the riser string so it will not collapse. The telescoping joint is composed of a pair of concentric pipes, known as an inner and outer barrel, that are axially telescoping within each other with the upper interior end of the outer barrel sealing against the exterior of the inner barrel. The lower end of the outer barrel connects to the upper end of the aforementioned riser string. The hydraulic tensioning system connects to a tension ring secured on the exterior of the outer barrel of the telescoping joint and thereby applies tension to the riser string. The upper end of the inner barrel of the telescoping joint is connected to the drilling platform. The axial telescoping of the inner barrel within the outer barrel of the telescoping joint compensates for relative elevation changes between the rig and wellhead housing as the rig moves up or down in response to the ocean waves.

Oil and gas drilling operations as described above occasionally are performed with multiple wellhead housings positioned in a grid pattern in a supporting structure known as a manifold placed on the ocean floor. In this type of operation it is necessary to lift the riser string and blowout preventer stack upwardly off one wellhead housing to allow the rig to be moved and the riser string and blowout preventer stack lowered onto the next wellhead housing. Current practice has required disconnection of the telescoping joint, tensioning lines and associated piping from the riser string in order to be able to lift the blowout preventer stack high enough to move to another wellhead housing. There is therefore a need for a tool that would allow lifting and moving of the riser string and blowout preventer stack without requiring disconnection of the tension joint, tensioning lines and associated piping from the riser string connection. The blowout preventer stack landing assist tool of the current invention offers such a tool that is easily useable without requiring any of the time consuming and costly disconnection and reconnecting procedures currently required.

2. Description of Related Art

No related art is known at this time.

SUMMARY OF THE INVENTION

The blowout preventer stack landing assist tool of the present invention is designed for use with a standard telescoping joint used in oil and gas drilling operations. The blowout preventer stack landing assist tool includes a main body having a drill pipe sub upper connection for connection to a handling string. An outer body surrounds the main body and has a bore that receives the main body therein. The main body is rotatable within the outer body. A plurality of keys is attached on the exterior of the outer body. A segment carrier body having a tapered outer portion has a thread on its interior that engages a mating thread on the lower end of the main body. A plurality of load segments slidably engages the tapered outer portion of the segment carrier body and are movable between retracted and extended positions by rotation of the main body to cause axial movement of the segment carrier body relative to the outer body and between extended and retracted positions by rotation of the main body in the opposite direction.

Additionally, a landing tool adapter joint for connection in the riser string between the telescoping joint and depending riser joints is provided. The adapter joint has a bore that includes a plurality of key slots for receiving the keys secured on the outer body of the blowout preventer stack landing assist tool and a load segment profile complementary to the load segments and receiving the load segments when in their extended position. In an alternate embodiment, the key slots and load segment profiles are machined into the lower interior of the outer barrel of the telescoping joint, thereby eliminating the need for the adapter joint.

A principal object of the present invention is to provide a blowout preventer stack landing assist tool and landing tool adapter joint for use with a standard telescoping joint used in oil and gas drilling operations that allows lifting and moving of the riser string and blowout preventer stack without requiring disconnection of the telescoping joint, tensioning lines and associated piping from the riser string connection.

These with other objects and advantages of the present invention are pointed out with specificness in the claims annexed hereto and form a part of this disclosure. A full and complete understanding of the invention may be had by reference to the accompanying drawings and description of the preferred embodiments.

BRIEF DESCRIPTION OF THE DRAWINGS

These and other objects and advantages of the present invention are set forth below and further made clear by reference to the drawings, wherein.

DESCRIPTION OF THE PREFERRED EMBODIMENTS

Figure 1A:
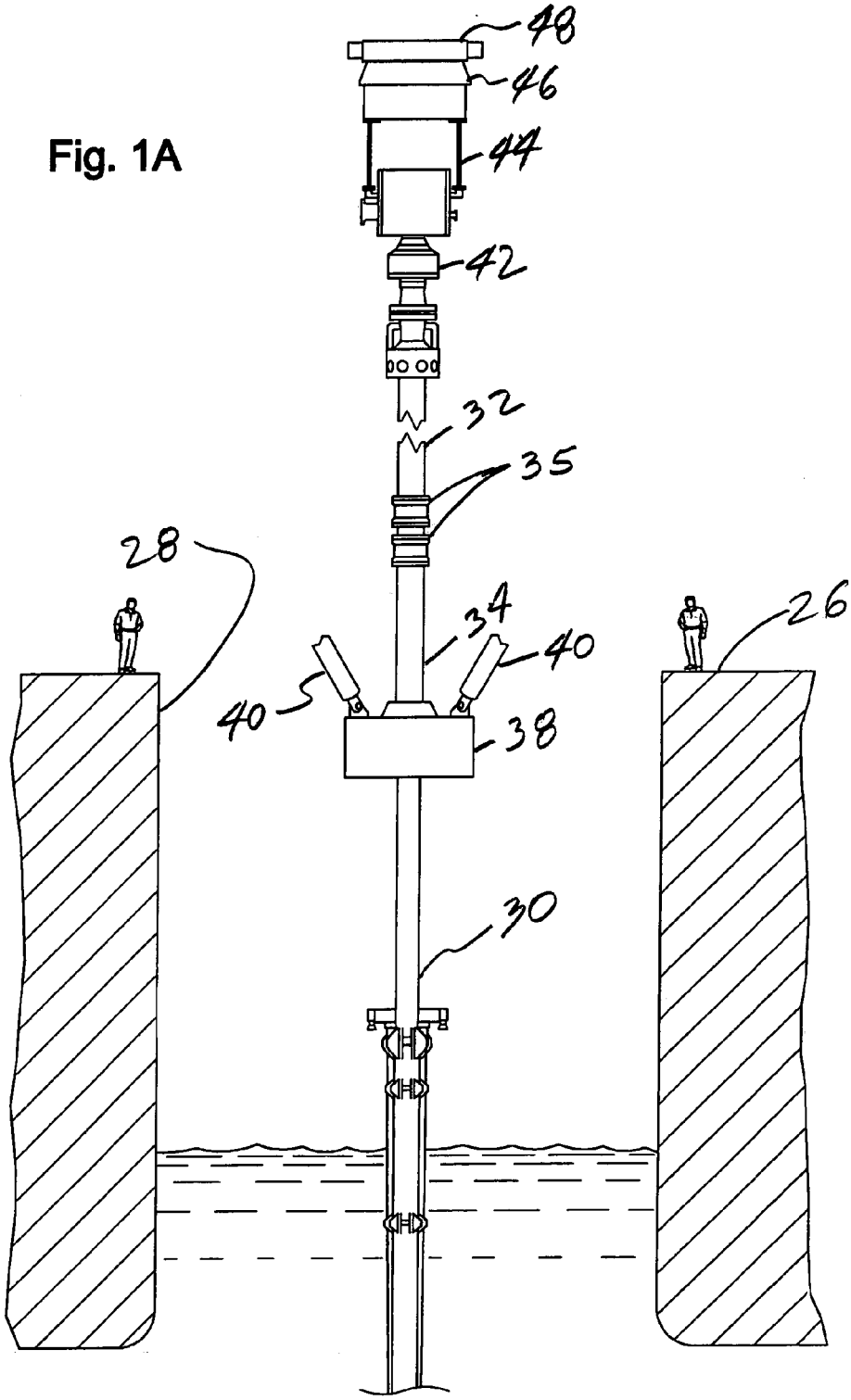
FIGS. 1A and 1B are an elevation view of a drilling rig with a typical riser string and blowout preventer stack used in oil and gas drilling operations connected to a wellhead housing. The riser string is connected to the telescoping joint by a landing tool adapter joint with an internal profile to allow use of the blowout preventer stack landing assist tool of the present invention.
Figure 1B:
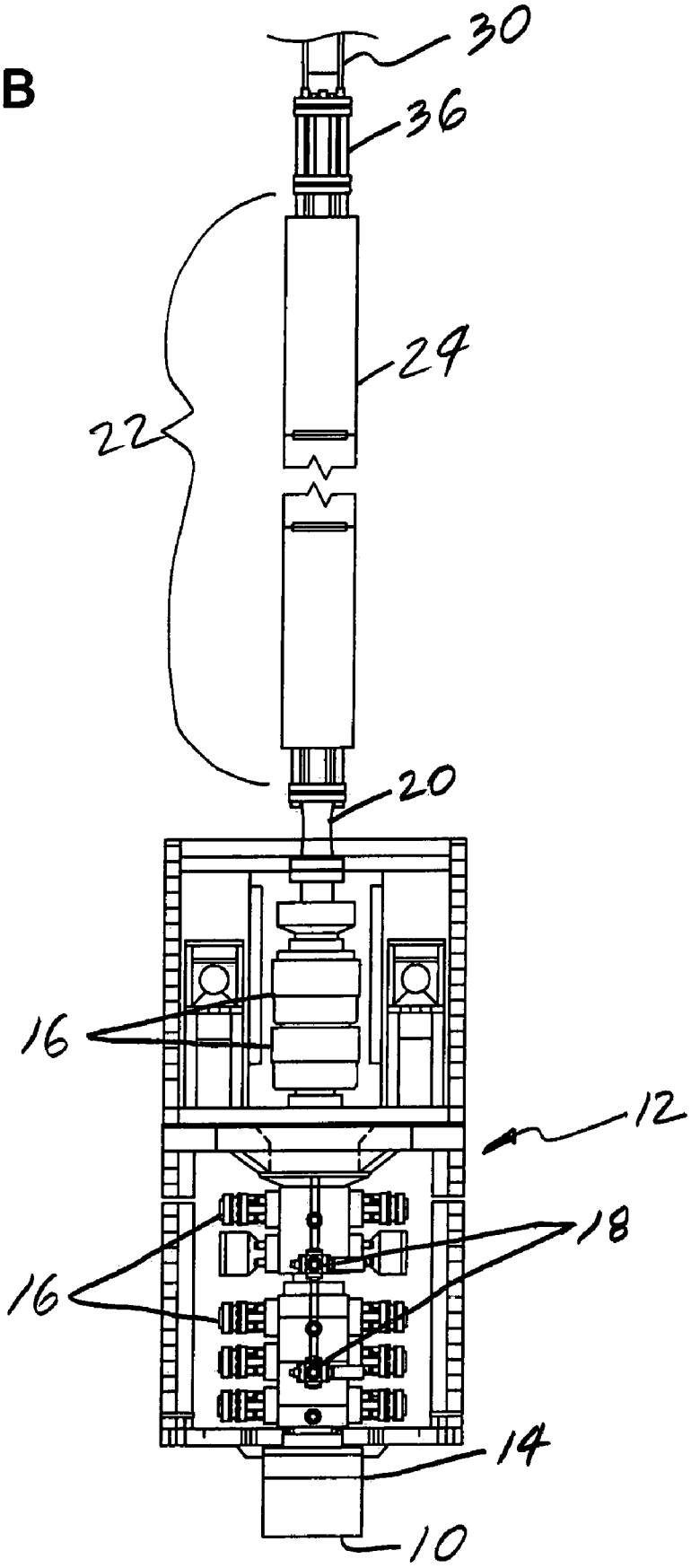

With reference to the drawings, and particularly to FIG. 1, an elevation view of a drilling rig with a typical riser string and blowout preventer stack used in oil and gas drilling operations connected to a wellhead housing is shown. Wellhead housing 10 is disposed on the ocean floor with blowout preventer stack 12 connected thereto by hydraulic connector 14. Blowout preventer stack 12 includes multiple blowout preventers 16 and kill and choke valves 18 arranged in a vertical arrangement to control well bore pressure in a manner well known to those of skill in the art. Disposed on the upper end of blowout preventer stack 12 is riser adapter 20 to allow connection of riser string 22 to blowout preventer stack 12. Riser string 22 is composed of multiple sections of pipe or riser joints 24 connected in end to end sealing connection that extends upwardly to drilling rig 26.

Drilling rig 26 includes moonpool 28 having telescoping joint 30 disposed therein. Telescoping joint 30 includes inner barrel 32 which telescopes inside outer barrel 34 to allow relative motion between drilling rig 26 and wellhead housing 10. Dual packer 35 is disposed at the upper end of outer barrel 34 and seals against the exterior of inner barrel 32. Landing tool adapter joint 36 is connected between the upper end of riser string 22 and outer barrel 34 of telescoping joint 30. Tension ring 38 is secured on the exterior of outer barrel 34 and connected by tension lines 40 to a hydraulic tensioning system well known to those of ordinary skill in the art. This arrangement allows tension to be applied by the hydraulic tensioning system to tension ring 38 and telescoping joint 30. This tension is transmitted through landing tool adapter joint 36 to riser string 22 to prevent its collapse. The upper end of inner barrel 32 is terminated by flex joint 42 and diverter 44 connecting to gimbal 46 and rotary table spider 48.

Figure 2A:
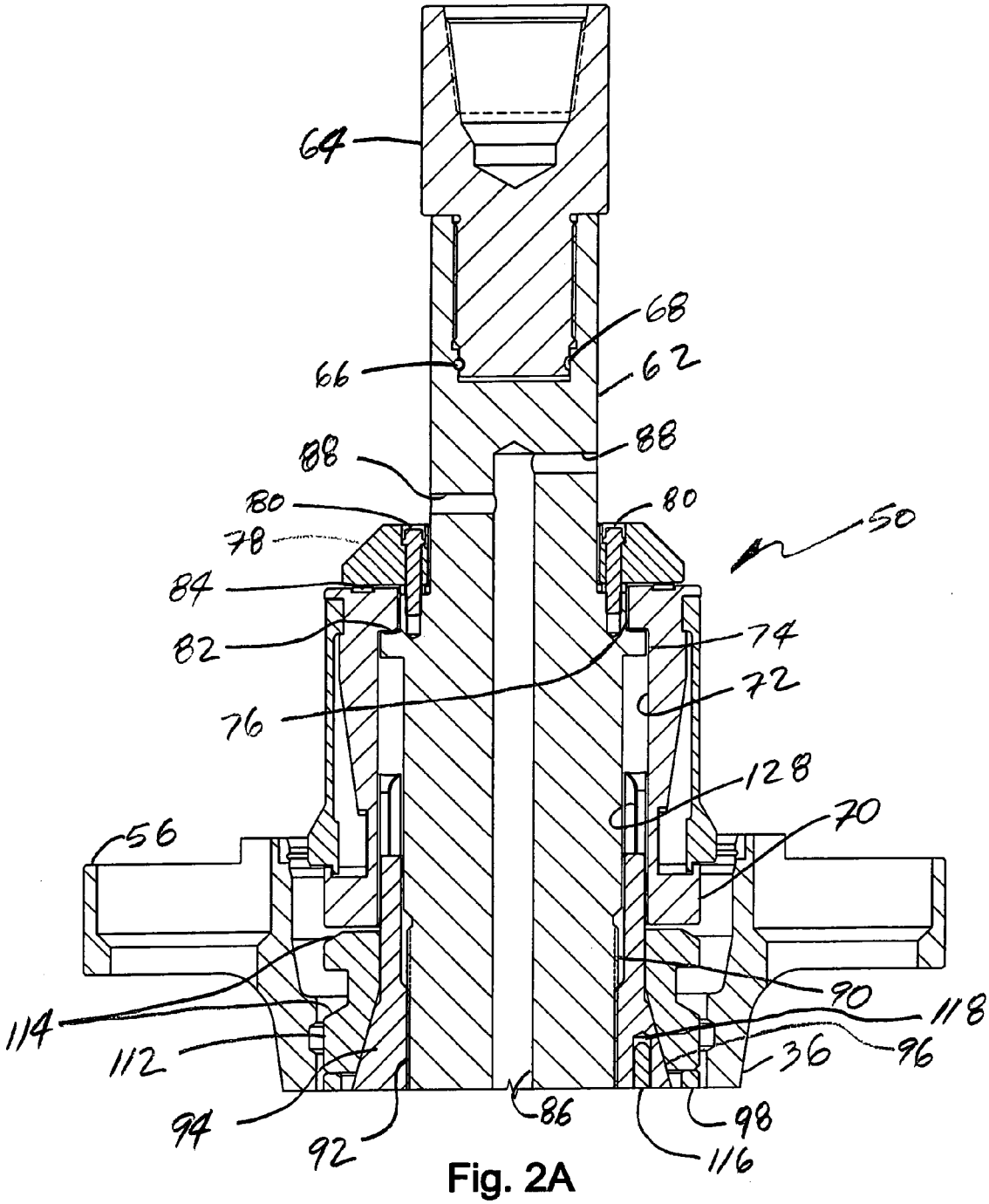
FIGS. 2A and 2B are a sectional view of the blowout preventer stack landing assist tool as it is being inserted into the landing tool adapter joint.
Figure 2B:
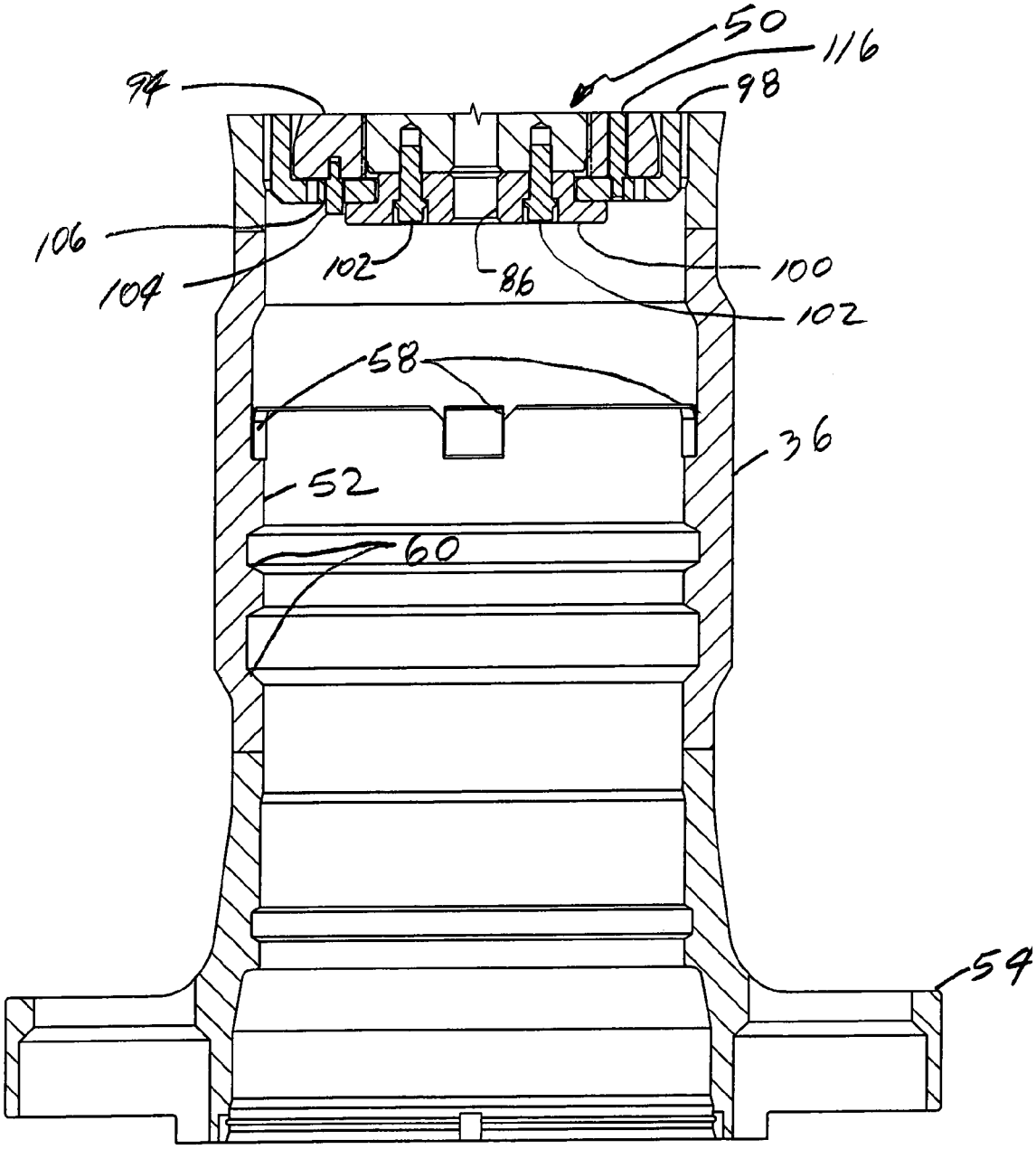

Referring to FIGS. 2A and 2B, blowout preventer stack landing assist tool 50 is shown being inserted or lowered into landing tool adapter joint 36. Landing tool adapter joint 36 is a tubular member with bore 52 having riser end flange 54 at its lower end and telescoping joint connection flange 56 at its upper end. Bore 52 is sized to be greater than or equal to the bore of riser string 22 and blowout preventer stack 12 to allow full bore access to wellhead housing 10. Disposed in bore 52 are anti-rotation slots 58 and load segment shoulder profiles 60 to allow landing and operation of blowout preventer stack landing assist tool 50 in a manner to be explained hereinafter.

Figure 3A:
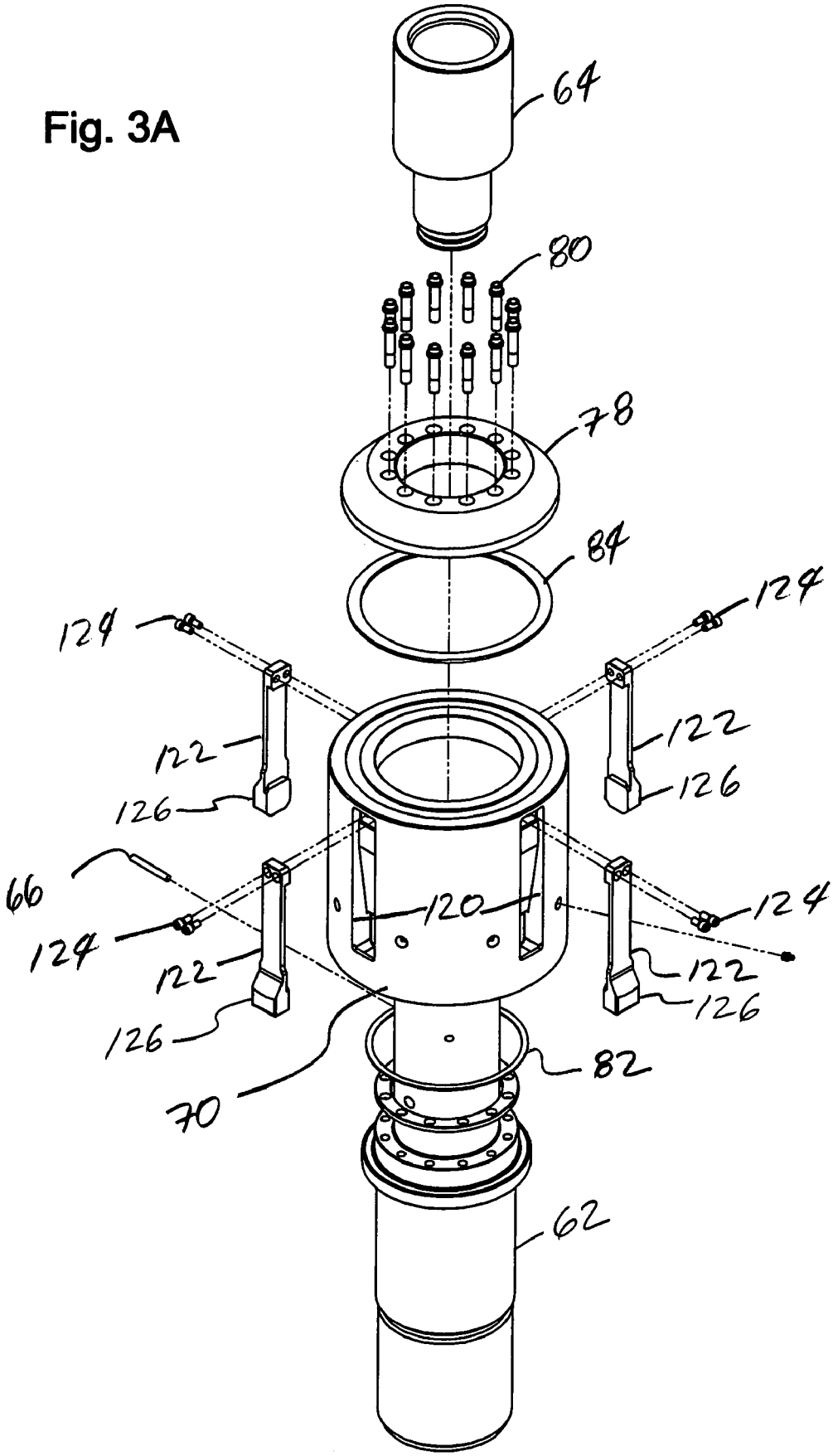
FIGS. 3A and 3B are an exploded view of the blowout preventer stack landing assist tool.
Figure 3B:
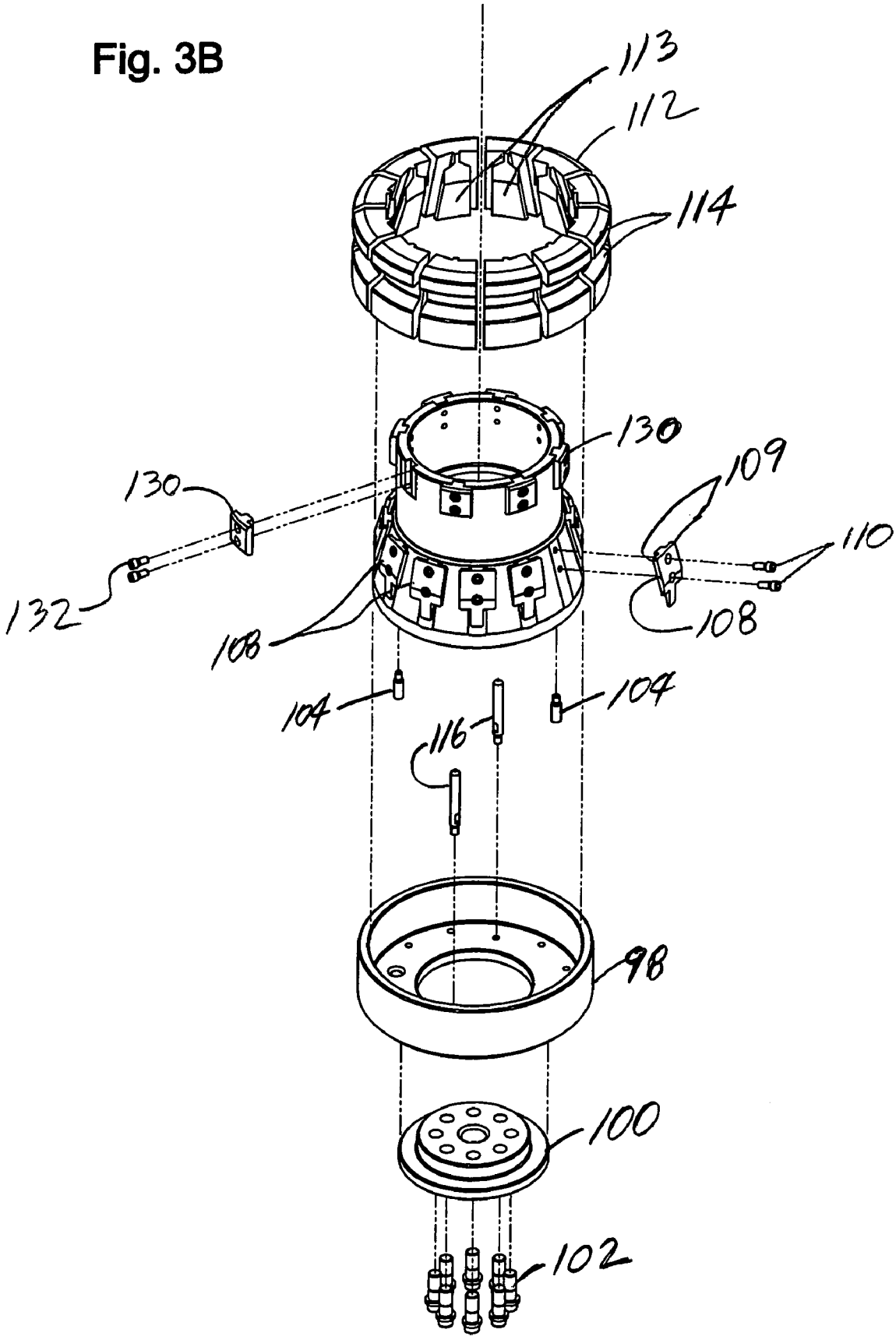

FIGS. 2A and 2B show a sectional view and FIGS. 3A and 3B an exploded view of blowout preventer stack landing assist tool 50 that includes main body 62 with drill pipe sub 64 threaded into its upper end. Lock pin 66 engages groove 68 on drill pipe sub 64 to prevent unthreading of drill pipe sub 64 from main body 62. Outer body 70 is a tubular member with bore 72 into which main body 62 fits. Main body 62 has radially outwardly extending shoulder 74 disposed on its exterior that engages radially inwardly extending shoulder 76 of outer body 70 to allow main body 62 to rotate within outer body 70. Shoulders 74 and 76 are maintained in engagement by retainer flange 78 that is secured to main body 62 by cap screws 80. Thrust bearing 82 is disposed between shoulders 74 and 76 and thrust bearing 84 is disposed between shoulder 76 and retainer flange 78 to facilitate rotation between main body 62 and outer body 70.

Mud return passage 86 extends axially from the lower end of main body 62 to a medial point of main body 62 to intersect a plurality of radially disposed mud return holes 88 that exit main body 62 between retainer flange 78 and drill pipe sub 64 to allow drilling mud within riser string 22 to flow through blowout preventer stack landing assist tool 50. Thread 90 is formed on the lower end of main body 62 and engages mating thread 92 on the interior of segment carrier body 94. Segment carrier body 94 is a generally tubular member having an expanded or tapered outer portion 96. Tapered outer portion 96 is surrounded by cup shaped end cap 98 that is retained on the lower end of main body 62 by retainer plate 100 which is secured by cap screws 102.

Segment carrier body 94 has position indicator rods 104 threaded into its lower end that extend through holes 106 in end cap 98 when blowout preventer stack landing assist tool 50 is in its running position. Circumferentially disposed on expanded or tapered outer portion 96 of segment carrier body 94 are a plurality of segment guides 108 that are secured to tapered outer portion 96 by cap screws 110. Load segments 112 are disposed on segment guides 108 and move radially outwardly when segment carrier body 94 moves axially. Load segments 112 include load shoulders 114 on their exterior that engage load segment shoulder profiles 60 of landing tool adapter joint 36. Segment guides 108 include lips 109 that engage mating T-slots 113 on the interior of load segments 112 to ensure positive extension and retraction of load segments 112. Guide rods 116 are threaded into end cap 98 and extend upwardly into the guide rod holes 118 in the lower end of segment carrier body 94.

Outer body 70 has key slots 120 formed on its exterior with anti-rotation keys 122 secured to outer body 70 at their upper end by cap screws 124. Anti-rotation keys 122 act as cantilever beams secured at their upper end by cap screws 124 that can bend and allow lower end profile 126 to move radially and engage anti-rotation slots 58. Axially disposed splines 128 are formed on the interior of outer body 70 and are engaged by anti-rotation keys 130 secured on segment carrier body 94 by cap screws 132 for purposes to be explained hereinafter.

Figure 4:
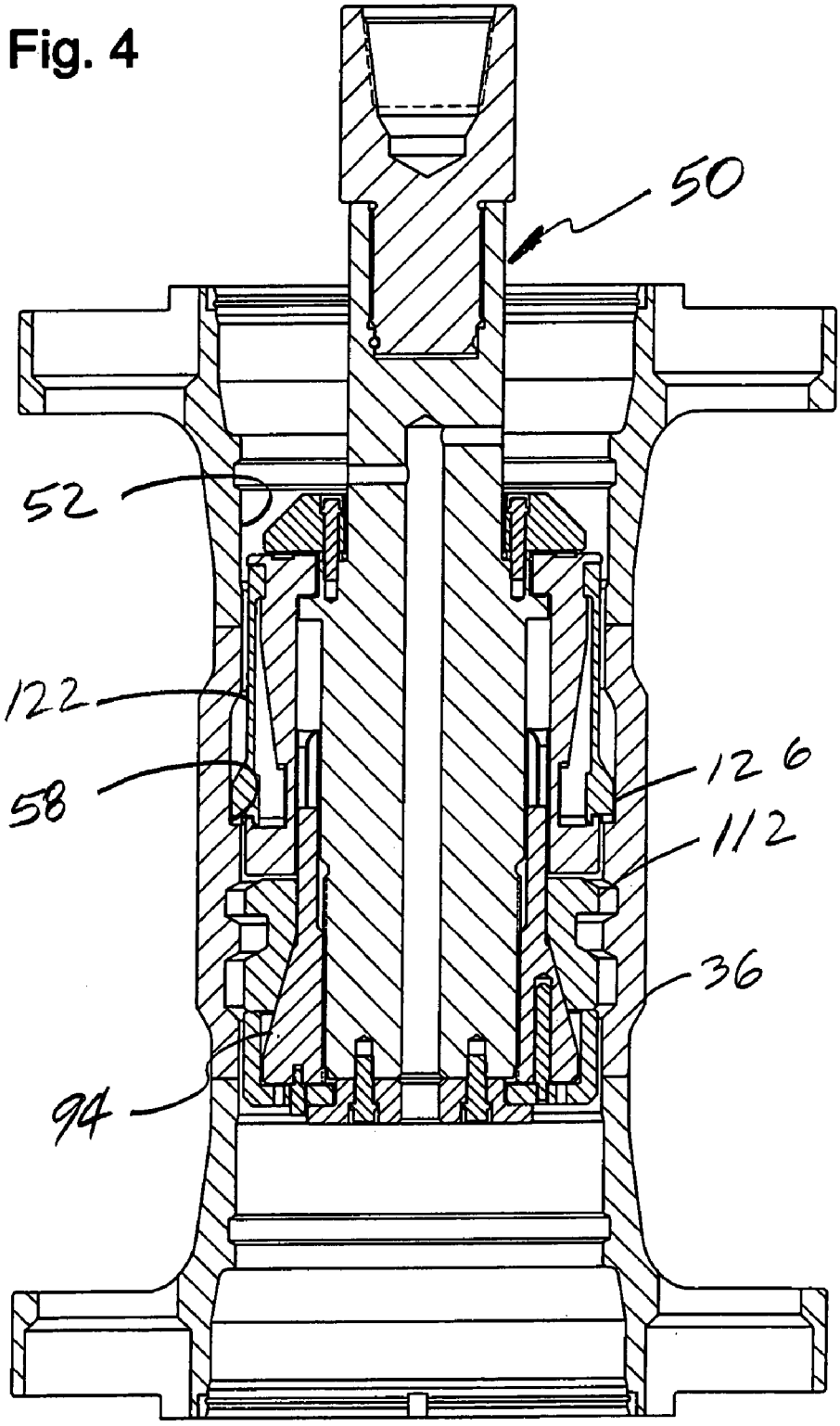
FIG. 4 is a sectional view of the blowout preventer stack landing assist tool initially landing in the landing tool adapter joint.
Figure 5:
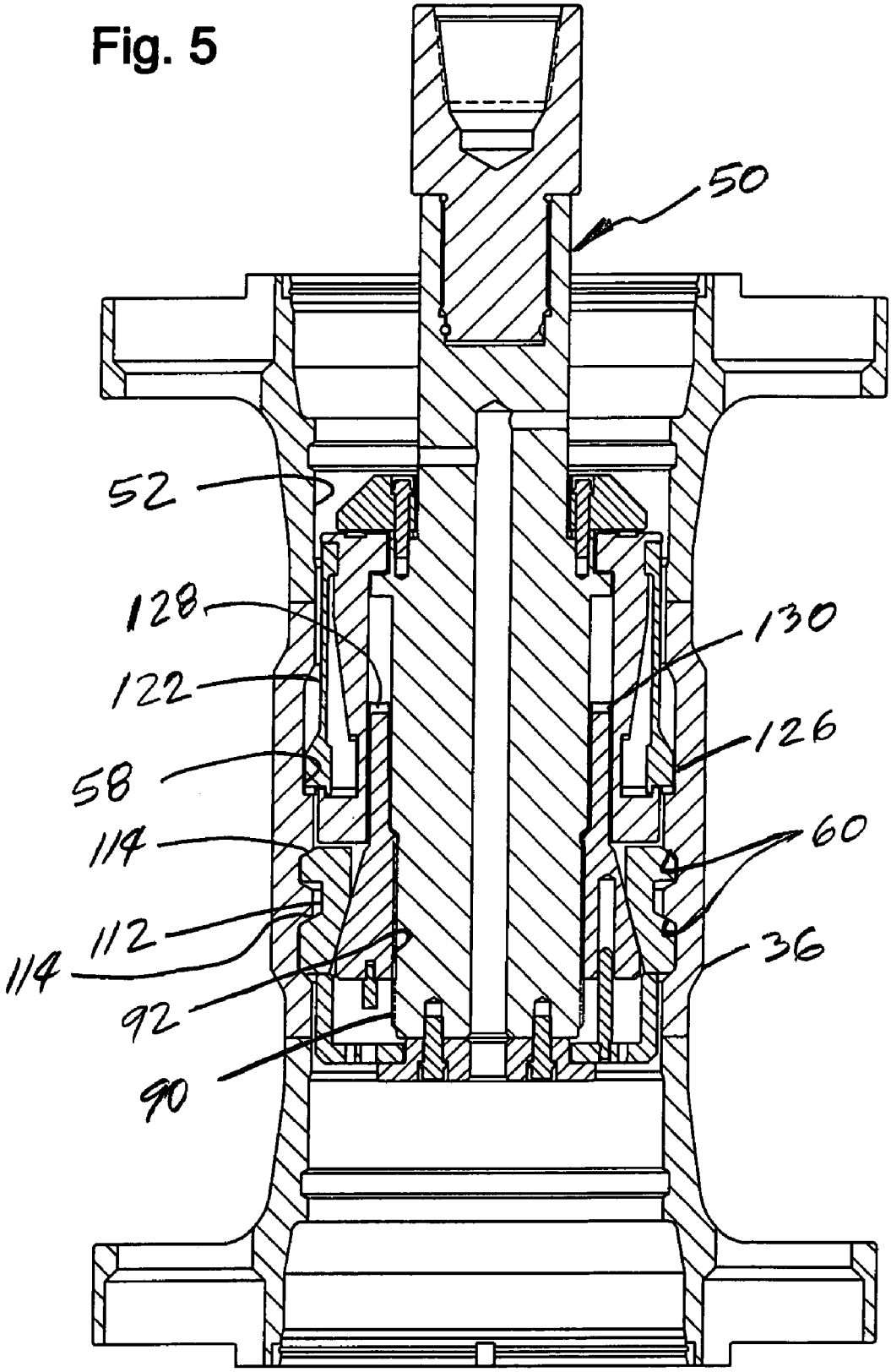
FIG. 5 is a sectional view of the blowout preventer stack landing assist tool landed and locked into the landing tool adapter joint.

Referring to FIGS. 4 and 5, a typical sequence of operation for use and operation of blowout preventer stack landing assist tool 50 with landing tool adapter joint 36 is shown. Segment carrier body 94 is at the lower end of its travel with load segments 112 disposed thereon in their retracted position. Blowout preventer stack landing assist tool 50 is then lowered through telescoping joint 30 on a drill pipe handling string (not shown) into landing tool adapter joint 36. Lower end profile 126 of anti-rotation keys 122 is sized to allow anti-rotation keys 122 to flex inwardly and ride along bore 52 of landing tool adapter joint 36 until lower end profile 126 reaches an elevation coincident with anti-rotation slots 58. At this point, the drill pipe handling string is rotated clockwise until lower end profile 126 aligns with anti-rotation slots 58 and then blowout preventer stack landing assist tool 50 is lowered approximately 2¼ inches to allow full engagement of lower end profile 126 with anti-rotation slots 58 as shown in FIG. 5. The operator then begins rotating the drill pipe handling string counter-clockwise to which main body 62 of blowout preventer stack landing assist tool 50 is connected. As anti-rotation keys 122 are engaging anti-rotation slots 58, outer body 70 is restrained from rotation. Simultaneously, anti-rotation keys 130 of segment carrier body 94 are engaging splines 128 on the interior of outer body 70 thereby also preventing segment carrier body 94 from rotating as threads 90 and 92 are engaging. This counter-clockwise rotation of main body 62 for a total of 7.5 turns causes segment carrier body 94 to move axially and urge load segments 112 radially outwardly to allow load shoulders 114 to engage load segment shoulder profiles 60 and thereby securely lock blowout preventer stack landing assist tool 50 into landing tool adapter joint 36. The drill pipe handling string can then be raised to lift riser string 22 and blowout preventer stack 12 to a sufficient height to allow blowout preventer stack 12 to be moved to a new wellhead housing and lowered into position. Once blowout preventer stack 12 is landed on the new wellhead housing, the drill pipe handling string is rotated 7.5 turns clockwise. This rotation causes segment carrier body 94 to move axially downwardly and lips 109 of segment carrier guides 108 to move along T-slots 113 of load segments 112 to provide positive mechanical retraction of lead segments 112 and ensure blowout preventer stack landing assist tool 50 can be released from landing tool adapter joint 36.

Figure 6:
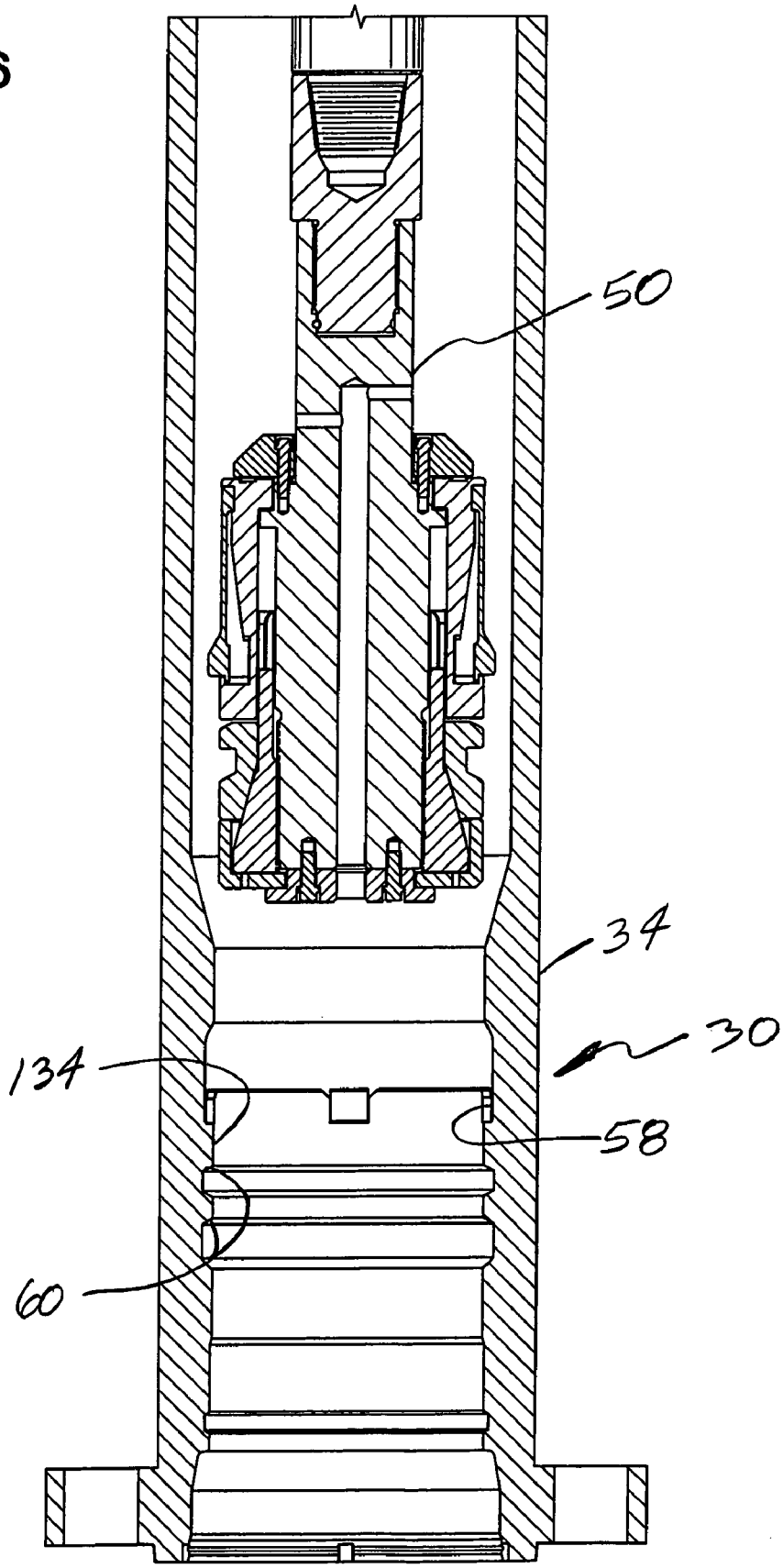
FIG. 6 is a sectional view of an alternate embodiment in which the key slots and load segment profiles of the landing tool adapter joint have been machined in the lower end of the outer barrel of a telescoping joint to eliminate the need for an adapter joint.

An alternate embodiment to allow use of the blowout preventer stack landing assist tool of the present invention is shown in FIG. 6. In this embodiment, anti-rotation slots 58 and load segment shoulder profiles 60 of landing tool adapter joint 36 are machined in bore 134 of the lower end of outer barrel 34 of telescoping joint 30. This type of construction eliminates the need for landing tool adapter joint 36 and allows the lifting and moving of telescoping joint 30, riser string 22 and blowout preventer stack 12 in a single operation without requiring lengthy disconnection and reconnecting procedures. Bore 134 is sized to be greater than or equal to the bore of riser string 22 and blowout preventer stack 12 as in the first embodiment to allow full bore access to wellhead housing 10.

The construction of our blowout preventer stack landing assist tool assembly will be readily understood from the foregoing description and it will be seen that we have provided a blowout preventer stack landing assist tool that allows lifting and moving of the riser string and blowout preventer stack without requiring disconnection of the tension joint, tensioning lines and associated piping from the riser string connection. Furthermore, while the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the appended claims

What is claimed is:

1. A blowout preventer stack landing assist tool assembly for use with a riser string comprising a telescoping joint and riser joints extending below the telescoping joint and secured to a blowout preventer stack, the tool assembly comprising:

(a) a blowout preventer stack landing assist tool, including;

(i) a main body having a drill pipe sub upper connection;

(ii) an outer body having a bore receiving said main body therein, said main body rotatable within said outer body;

(iii) a plurality of keys secured on said outer body;

(iv) a segment carrier body threadably engaging a lower end of said main body, said segment carrier body having a tapered outer portion;

(v) a plurality of load segments slidably engaging said tapered outer portion of said segment carrier body, said plurality of load segments movable between retracted and extended positions by axial movement of said segment carrier body relative to said outer body; and, (b) a blowout preventer stack landing tool adapter joint connectable in the riser string between the telescoping joint and riser joints extending below the telescoping joint, said blowout preventer stack landing tool adapter joint having a bore therethrough including a plurality of key slots for receiving said keys secured on said outer body of said blowout preventer stack landing assist tool and a plurality of load segment shoulder profiles complementary to said load segments and receiving said load segments when in their extended position.

2. A blowout preventer stack landing assist tool assembly, according to claim 1, wherein:

said blowout preventer stack landing assist tool keys are radially flexible between a first position allowing said keys to move axially along the bore of said blowout preventer stack landing tool adapter joint and a second position wherein said keys engage said key slots in said bore to position said blowout preventer stack landing assist tool and to prevent rotation of said outer body relative to said landing tool adapter joint.

3. A blowout preventer stack landing assist tool assembly, according to claim 2, wherein:

said load segments are urged radially into engagement with a plurality of load segment shoulder profiles by axial movement of said segment carrier body when said main body is rotated.

4. A blowout preventer stack landing assist tool assembly, according to claim 3, wherein:

said load segments include a plurality of shoulders on their exterior, said plurality of load segment shoulders engaging said plurality of complementary load segment shoulder profiles in said blowout preventer stack landing tool adapter joint.

5. A blowout preventer stack landing assist tool assembly, according to claim 4, including:

a plurality of segment guides disposed on said tapered outer portion of said segment carrier body, said segment guides having plurality of lips; and, a slot disposed on the interior of said load segments, said load segment slot engaging said segment guide lips and providing positive extension and retraction of said load segments by axial movement of said segment carrier body when said main body is rotated.

6. A blowout preventer stack landing assist tool assembly, according to claim 5, including:

an end cap retained on the lower end of said main body by a retainer plate secured to said main body by securing means; and, said end cap preventing said segment carrier body from unthreading from said main body.

7. A blowout preventer stack landing assist tool assembly, according to claim 6, wherein:

said segment carrier body includes a plurality of position indicator rods secured thereto, said position indicator rods extending through said end cap.

8. A blowout preventer stack landing assist tool assembly, according to claim 7, wherein:

said end cap including a plurality of guide rods secured thereto, said guide rods extending axially into complementary holes in said segment carrier body.

9. A blowout preventer stack landing assist tool assembly, according to claim 8, wherein:

said segment carrier body further including anti-rotation keys secured thereto; and, said segment carrier body anti-rotation keys engaging complementary splines on the interior of said outer body to prevent rotation therebetween.

10. A blowout preventer stack landing assist tool assembly, according to claim 9, further comprising:

said main body including a radially outwardly extending shoulder engaging a radially inwardly extending shoulder formed in said outer body bore with a bearing positioned therebetween; and, a bearing arranged on an upper face of said outer body, said bearing retained by a retainer cap secured to said main body.

11. A blowout preventer stack landing assist tool assembly, according to claim 10, wherein:

said main body further includes a mud return passage extending axially from said lower end thereof to a medial point and intersecting a plurality of radially disposed mud return holes that exit said main body between said main body bearing retainer cap and said drill pipe sub upper connection.

12. A blowout preventer stack landing assist tool for use with a telescoping joint including inner and outer barrels with inner bores, the telescoping joint including a riser string and blowout preventer stack secured thereto, comprising:

a main body adapted to receive a drill pipe adapter sub at its upper end;

an outer body having a bore receiving said main body therein, said main body rotatable within said outer body;

a plurality of keys secured on said outer body;

a segment carrier body engaging a lower end of said main body with complementary threads, said segment carrier body having a tapered outer portion;

a plurality of load segments slidably engaging said tapered outer portion of said segment carrier body, said plurality of load segments movable between retracted and extended positions by axial movement of said segment carrier body relative to said outer body; and, a profile formed in a portion of the bore of the outer barrel of the telescoping joint, said profile including a plurality of key slots for receiving said keys secured on said outer body and a plurality of load segment shoulder profiles complementary to said load segments and receiving said load segments when in their extended position.

13. A blowout preventer stack landing assist tool for use with a telescoping joint having a riser string and blowout preventer stack secured thereto, according to claim 12, wherein:

said keys are radially flexible between a first position allowing said keys to move axially along said telescoping joint inner and outer barrel bores and a second position wherein said keys engage said key slots in said outer barrel bore to position said outer body and to prevent rotation of said outer body relative to said telescoping joint outer barrel.

14. A blowout preventer stack landing assist tool for use with a telescoping joint having a riser string and blowout preventer stack secured thereto, according to claim 13, wherein:

said load segments are urged radially into engagement with said load segment profiles by axial movement of said segment carrier body when said main body is rotated.

15. A blowout preventer stack landing assist tool for use with a telescoping joint having a riser string and blowout preventer stack secured thereto, according to claim 14, wherein:

said load segments include a plurality of shoulders on their exterior, said plurality of load segment shoulders engaging said plurality of complementary load segment shoulder profiles in said outer barrel bore.

16. A blowout preventer stack landing assist tool assembly, according to claim 15, including:

a plurality of segment guides disposed on said tapered outer portion of said segment carrier body, said segment guides having plurality of lips; and, a slot disposed on the interior of said load segments, said load segment slot engaging said segment guide lips and providing positive extension and retraction of said load segments by axial movement of said segment carrier body when said main body is rotated.

17. A blowout preventer stack landing assist tool for use with a telescoping joint having a riser string and blowout preventer stack secured thereto, according to claim 16, including:

an end cap retained on the lower end of said main body by a retainer plate secured to said main body by securing means; and, said end cap preventing said segment carrier body from unthreading from said main body.

18. A blowout preventer stack landing assist tool for use with a telescoping joint having a riser string and blowout preventer stack secured thereto, according to claim 17, wherein:

said end cap including a plurality of guide rods secured thereto, said guide rods extending axially into complementary holes in said segment carrier body.

19. A blowout preventer stack landing assist tool for use with a telescoping joint having a riser string and blowout preventer stack secured thereto, according to claim 18, wherein:

said segment carrier body further including anti-rotation keys secured thereto; and, said segment carrier body anti-rotation keys engaging complementary splines on the interior of said outer body to prevent rotation therebetween.

20. A blowout preventer stack landing assist tool for use with a telescoping joint having a riser string and blowout preventer stack secured thereto, according to claim 19, further comprising:

said main body including a radially outwardly extending shoulder engaging a radially inwardly extending shoulder formed in said outer body bore with a bearing positioned therebetween; and, a bearing arranged on an upper face of said outer body, said bearing retained by a retainer cap secured to said main body.

21. A blowout preventer stack landing assist tool for use with a telescoping joint having a riser string and blowout preventer stack secured thereto, according to claim 20, wherein:

said main body further includes a mud return passage extending axially from said lower end thereof to a medial point and intersecting a plurality of radially disposed mud return holes that exit said main body between said main body bearing retainer cap and said drill pipe sub.

22. A blowout preventer stack landing assist tool for use with a telescoping joint having a riser string and blowout preventer stack secured thereto, according to claim 16, wherein:

said segment carrier body includes a plurality of position indicator rods secured thereto, said position indicator rods extending through said end cap.

* * * * *